US007241173B2

(12) United States Patent
Callahan et al.

(10) Patent No.: US 7,241,173 B2
(45) Date of Patent: Jul. 10, 2007

(54) ELECTRICAL CONNECTOR INSERT AND APPARATUS AND ASSOCIATED FABRICATION METHOD

(75) Inventors: Kevin S. Callahan, Shoreline, WA (US); Daniel J. Diessner, Mukilteo, WA (US); Bradley J. Mitchell, Snohornish, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 11/484,146

(22) Filed: Jul. 10, 2006

(65) Prior Publication Data

US 2006/0258210 A1 Nov. 16, 2006

Related U.S. Application Data

(62) Division of application No. 10/757,838, filed on Jan. 15, 2004, now Pat. No. 7,074,073.

(51) Int. Cl.
*H01R 9/05* (2006.01)

(52) U.S. Cl. ..... 439/579

(58) Field of Classification Search ..... 439/579, 439/498, 379, 389, 701, 287, 492, 67, 77, 439/260–267

See application file for complete search history.

(56) References Cited

U.S. PATENT DOCUMENTS 3,873,172 A * 3/1975 Paullus ..... 439/498
4,954,101 A 9/1990 Nelson
4,975,068 A * 12/1990 Squires ..... 439/67
6,132,247 A 10/2000 Liou et al.
6,165,009 A 12/2000 Anbo et al.
6,210,229 B1 4/2001 Lai
6,231,354 B1 5/2001 Church et al.
6,273,753 B1 8/2001 Ko
6,309,223 B1 * 10/2001 Wolfe ..... 439/67
6,554,639 B2 4/2003 Doriski, Jr.
6,793,527 B2 9/2004 Noro

* cited by examiner

*Primary Examiner*—J. F. Duverne
(74) *Attorney, Agent, or Firm*—Alston & Bird LLP

(57) ABSTRACT

The electrical connector insert, apparatus and associated fabrication method provide a connector insert attached to flat wire segments. In addition, the connector insert retains the industry accepted openings into which connection portions, such as pins, of the component are positioned. The insert includes at least one housing, which includes multiple openings to receive at least one connector portion of at least one component and multiple conductive contacts, such as conductive pins and/or conductive sockets, that extend at least partially within the at least one housing, where each conductive contact is associated with an opening. The insert also includes at least one flat wire segment having conductive traces and connection elements to connect the conductive contacts of the housing to the conductive traces. If there are at least two housings, the housings may be sized and shaped to cooperate with each other when the housings are positioned adjacent one another.

11 Claims, 5 Drawing Sheets

ELECTRICAL CONNECTOR INSERT AND APPARATUS AND ASSOCIATED FABRICATION METHOD

CROSS-REFERENCE TO RELATED APPLICATIONS

This application is a divisional of U.S. application Ser. No. 10/757,838, filed Jan. 15, 2004 now U.S. Pat. No. 7,074,073, which is hereby incorporated herein in its entirety by reference.

FIELD OF THE INVENTION

The present invention relates to electrical connector inserts that provide connections between components and flat wire segments.

BACKGROUND OF THE INVENTION

Electrical connector inserts are used to provide an interface for connecting a component to conventional wiring that transmits signals to and from the component. Thus, a typical electrical connector insert, such as those manufactured to the ARINC 600 specification for the aerospace industry and commercially available from Tri-Star Electronics and others, includes openings on one side into which connection portions of the component, such as pins, may be placed and connections to single wires or small wire bundles on an opposite side. A component may be any type of electrical equipment, any type of wiring, any type of connector, or any other type of electrical element. The openings of an insert may be arranged in any manner to interface with a desired component. Thus, the openings of an insert are typically defined based upon the arrangement, size and shape of the connection portions of the component to which the insert provides an interface to the wiring. Examples of single wires or small wire bundles include one or more single wires, coaxial wires, twisted wire pairs, and optical fibers.

In many industries, such as the aerospace industry, components are arranged in trays that are placed on shelves in a rack. For example, in an aircraft, there may be many shelves and racks of various types of components. To hold the electrical connector inserts at an appropriate position to interface with the desired components and to permit blind mating of the inserts with respective components, one or more connector inserts may be positioned within a connector shell. The connector shell, therefore, defines openings into which connector inserts may be positioned, and the location of the openings in the shell correspond to the position of the connector portions of a respective component.

Flat wire, which may also be known as flex circuit, may be used in a variety of applications to provide connectivity between desired elements. Flat wire, as known to those skilled in the art, is made of multiple substantially parallel conductive traces defined upon an insulative material, where the conductive traces are laid out in a planar arrangement. Thus, flat wire is capable of providing numerous conductive traces that are separated by sufficient insulation to prevent any interference among the traces and to permit easy access to the traces. Flat wire is typically utilized in computer technologies and microelectronics.

As the disclosure of U.S. patent application Ser. No. 10/731,829, entitled "An Integration Area, System and Method for Providing Interconnections Among Components" filed on Dec. 9, 2003 describes, flat wire may be used for integration areas that provide interconnections within, between or among various components. These integration areas provide efficient, easy to access and easy to modify interconnections that are separate from the conductive path between components. As such, the conductive path is not complicated by the interconnections. As described in the above-referenced application, at least some of the integration areas made from flat wire segments may be attached to the connector inserts to provide interconnections within and between the components associated with the connector inserts.

Thus, it would be advantageous to utilize a connector insert that is directly attached to a flat wire segment to take advantage of the various integration areas that flat wire segments afford, as described in the above-referenced application. While conventional connectors utilized in computer technologies and microelectronics may be attached to flat wire segments, conventional connector inserts are only capable of connecting to single or small numbers of wires in bundles, not flat wire segments that include numerous conductive traces separated by insulation. The conventional connectors utilized in computer technologies and microelectronics would not work for connector inserts because such connectors are not designed to integrate the various types of connection portions of components that are required of connector inserts. Thus, there is a need for a connector insert attached to flat wire segments. In addition, the connector insert should retain the industry accepted openings into which connection portions of the component are positioned.

BRIEF SUMMARY OF THE INVENTION

The electrical connector insert, apparatus and associated fabrication method provide a connector insert attached to flat wire segments. In addition, the connector insert retains the industry accepted openings into which connection portions, such as pins, of the component are positioned.

The electrical connector insert of the present invention includes at least one housing, which includes multiple openings to receive at least one connector portion of at least one component and multiple conductive contacts, such as conductive pins and/or conductive sockets, that extend at least partially within the at least one housing, where each conductive contact is associated with an opening. In one embodiment, the housing may be made of multiple wafers that are positioned adjacent one another. The electrical connector insert also includes at least one flat wire segment that includes multiple conductive traces and multiple connection elements to connect the conductive contacts of the housing to the conductive traces. The flat wire segment(s) may include electromagnetic shielding. In addition, a support element may be included in one embodiment of the housing to support at least a portion of the flat wire segment (s). In embodiments in which there are at least two housings, the housings may be sized and shaped to cooperate with each other when the housings are positioned adjacent one another.

In some embodiments of the electrical connector insert of the present invention, the connection elements may include wire segments that extend from the conductive contacts to the conductive traces. In one embodiment, the conductive contacts may be at least part of the connection elements. The connection elements may include solder joints to connect the connection elements to the wire segment(s), in certain embodiments. In further embodiments, the conductive traces may include at least one connection via, and the connection elements connect the conductive contacts to the connection via(s).

In one embodiment of the electrical connector insert, the housing defines an aperture to receive a portion of the flat wire segment(s), such that the connection elements connect the conductive contacts on both major surfaces of the flat wire segment(s) when a flat wire segment is positioned within the aperture in the housing.

The electrical connector apparatus of the present invention includes a connector insert shell that defines at least one opening that extends through opposite sides of the shell and at least one electrical connector insert, as defined above, positioned within the opening(s).

The method for fabricating an electrical connector insert according to the present invention includes defining openings in at least one housing to receive at least one connector portion of at least one component, placing conductive contacts, such as conductive pins and/or conductive sockets, at least partially within each of the openings, and connecting conductive traces defined in at least one flat wire segment to the conductive contacts. In one embodiment of the method, the flat wire segment(s) may be connected to the conductive contacts with a support element that extends from the housing(s). In various other embodiments of the method, to connect the conductive traces to the conductive contacts, connection elements may be attached between the conductive contacts and the conductive traces and/or the conductive contacts may be soldered to connection vias in the conductive traces. In embodiments in which there are at least two housings, the housings may be arranged adjacent to one another. In further embodiments, the housing may be made of multiple wafers in which openings are defined; and the wafers may be positioned adjacent one another.

Thus, the electrical connector insert, apparatus and associated fabrication method provide a connector insert attached to flat wire segments; and the connector insert retains the industry accepted openings into which connection portions, such as pins, of the component are positioned.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The electrical connector insert, apparatus and associated fabrication method provide a connector insert attached to flat wire segments. In addition, the connector insert retains the industry accepted openings into which connection portions, such as pins, of the component are positioned.

Figure 1:
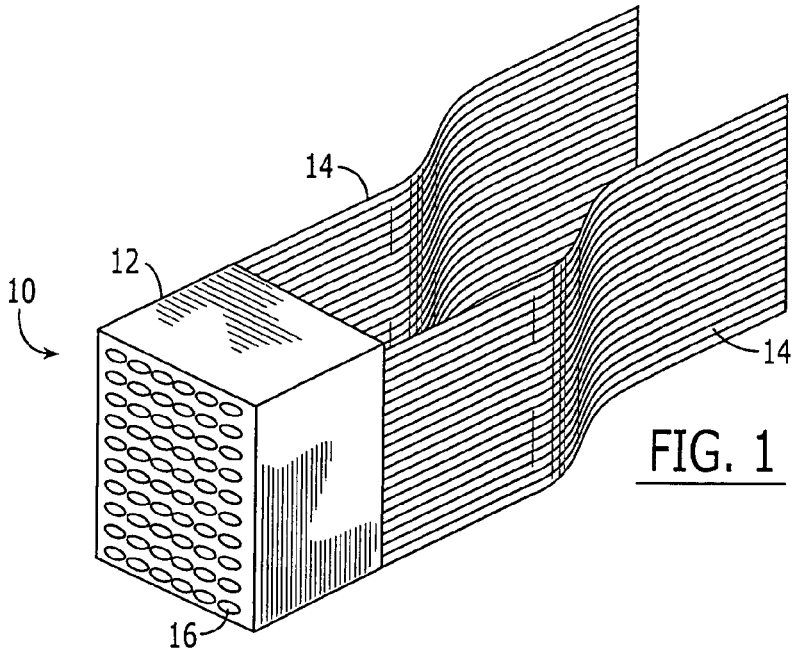
FIG. 1 illustrates a perspective view of an electrical connector insert, according to one embodiment of the present invention.

FIG. 1 illustrates one embodiment of an electrical connector insert 10. The insert 10 includes a housing 12 and at least one flat wire segment 14. The housing 12 defines openings 16 to receive connection portions, such as pins, of at least one component. The openings 16 may be arranged in any manner known to those skilled in the art to be capable of receiving connection portions of a component, such as a Line Replaceable Unit (LRU) or other electrical device in an aircraft, for instance. In one embodiment, the openings 16 may be arranged according to any connector insert arrangement provided by an ARINC 600 connector insert, commercially available from Tri-Star Electronics and others.

Figure 2A:
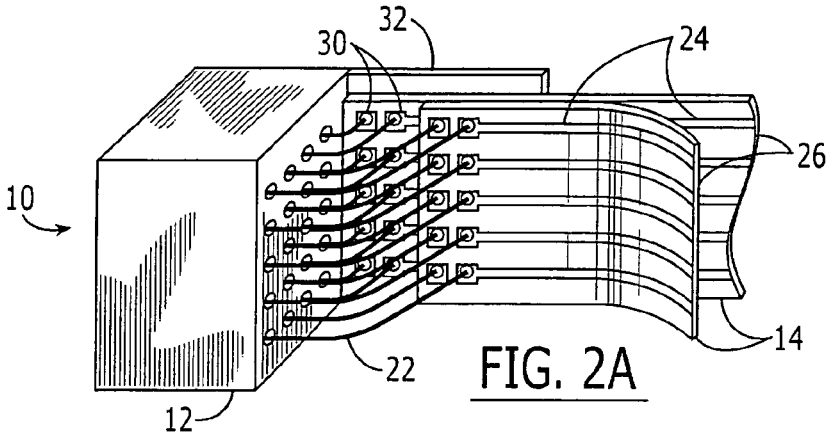
FIGS. 2A and 2B illustrate a perspective view and a cut-way side view, respectively, of an electrical insert connector and the connections between the conductive contacts of the housing and the flat wire segment(s), according to one embodiment of the present invention.
Figure 2B:
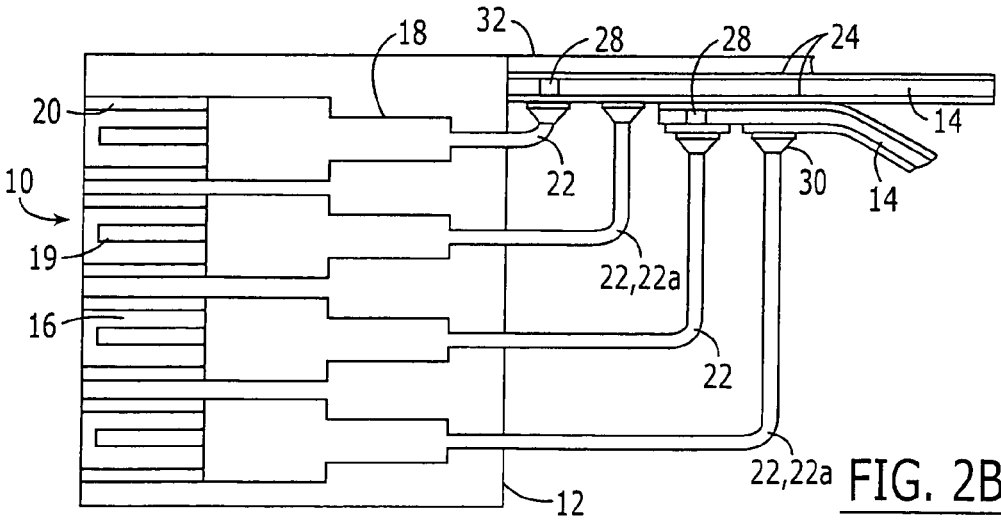

Each opening 16 defined in the housing 12 may be associated with a conductive pin and/or conductive socket, which are collectively known as electrical contacts or conductive contacts, as known to those skilled in the art. FIG. 2B, which is also discussed below, illustrates the location of the conductive contacts in the housing 12. FIG. 2B illustrates a cut-away view of an electrical connector insert 10. As shown in FIG. 2B, each opening 16 includes a conductive contact 18, which is shown as a conductive pin 19 in this embodiment. The conductive contacts 18 may have any shape desired to conductively connect to the connector portion of the component(s). Alternatively or additionally, each opening 16 may contain a conductive socket 20. A conductive socket generally defines a cavity with an inside surface that is conductive, such that conductive sockets may be inserted in openings 16 similar to the manner in which conductive pins 19 are inserted in openings 16.

The flat wire segment(s) 14 are connected to the conductive contacts 18 via connection elements 22. Connection elements 22 may be any type of conductive element that extends from the conductive contacts to the flat wire segment(s) 14. For example, as shown in FIGS. 2A and 2B, the connection elements 22 may be wire segments that extend from conductive contacts 18 to the conductive traces 24 of the flat wire segment(s) 14. The connection elements 22 may be part of the conductive contacts 18, such that one end of the conductive contacts 18 extends from the housing 12 to the flat wire segment(s) 14.

As mentioned above, the flat wire segment(s) 14 include conductive traces 24. As shown in FIGS. 2A and 2B, the conductive traces 24 are typically separated by insulative portions 26. Thus, the connection elements 22 may be connected to the conductive traces 24 of the flat wire segment(s) 14 by any technique known to those skilled in the art. For instance, as shown in FIG. 2B, some connection elements 22 may be directly connected to conductive traces that are exposed, such as by soldering or the like. See, for example, connection elements 22*a*. In order to expose a number of conductive traces to permit direct connection with respective connection elements, the flat wire segment (s) 14 may be layered upon one another in a staggered manner as shown in FIGS. 2A and 2B. In instances in which a connection element cannot be directly connected to a conductive trace, a connection element may be electrically connected to a conductive trace by means of one or more connection vias 28 that are defined through the flat wire segment(s) 14 that overlie the respective conductive trace. The connection via may be filled or the walls of the via may be coated or plated with a conductive material to provide the desired connectivity. A connection element 22 may, therefore, connect to a conductive trace 24 at a respective connection via 28 using any connection technique known to those skilled in the art. For example, as shown in FIGS. 2A and 2B, a connection element 22 may be soldered to a respective connection via 28 at solder joints 30.

The flat wire segment(s) 14 also may include electromagnetic shielding that is typically a layer of conductive material, such as copper, that is applied to at least a portion of one or both of the major surfaces of a flat wire segment.

The electrical connector insert 10 also may include a support element 32 to support at least a portion of the flat wire segment(s) 14, such as by providing strain relief for at least a portion of the flat wire segment(s) 14. For example, the support element 32 may extend from the housing 12 in a direction substantially parallel to the axis of openings 16 in the housing, as shown in FIGS. 2A, 2B and 3B. In other embodiments of the electrical connector insert 10, the support element 32 may extend from the housing in any other direction depending upon the desired direction of the flat wire segment(s) 14. Typically, the support element extends in a parallel manner relative to the flat wire segment(s) 14. The support element 32 may be attached to the housing in any manner known to those skilled in the art. For example, the support element 32 may be molded as a part of the housing 12. In other embodiments, the support element 32 and the housing 12 may be shaped to cooperate with each other such that the support element 32 may be securedly fixed onto the housing.

Figure 3A:
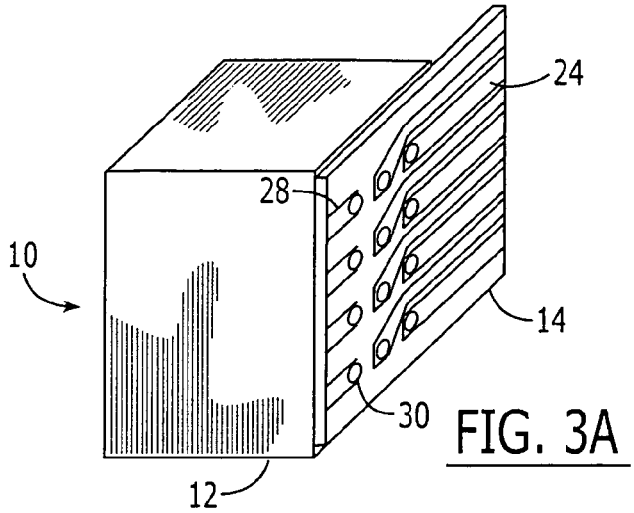
FIGS. 3A and 3B illustrate a perspective view and a cut-way side view, respectively, of an electrical insert connector and the connections between the conductive contacts of the housing and the flat wire segment(s), according to one embodiment of the present invention.
Figure 3B:
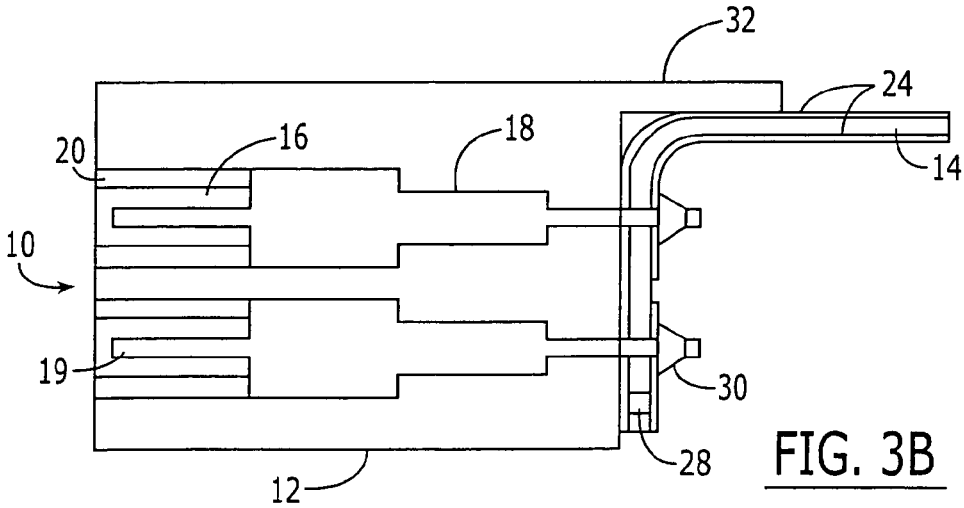

FIGS. 3A and 3B illustrate further embodiments of the electrical connector insert 10 of the present invention. As shown in FIG. 3B, the flat wire segment(s), also known to those skilled in the art as flex circuit, are flexible and can bend to accommodate various applications. FIGS. 3A and 3B illustrate an embodiment of the electrical connector insert 10 in which the flat wire segment(s) 14 are in direct contact with the housing 12, such that the conductive contacts 18 (or connection elements that are connected to the conductive contacts 18 as described above) are in direct electrical contact with and generally extend through the flat wire segment(s) 14. Thus, the conductive contacts 18 or other connection element may extend through openings defined in the flat wire segments 14 at desired locations in order to connect the conductive contacts 18 to the desired conductive trace(s) 24. The conductive contacts 18 and/or other connection element may be connected to the desired conductive trace(s) 24 in any manner known to those skilled in the art, such as by soldering the conductive contacts 18 and/or other connection element to the desired conductive trace(s) 24 at solder joints 30. As described with respect to FIG. 2B, the flat wire segment(s) may also include connection vias 28 that extend through one or more of the flat wire segments 14 to provide connections between conductive traces 24 on either side of a respective flat wire segment 14 and/or between conductive traces in adjacent flat wire segments.

Figure 4:
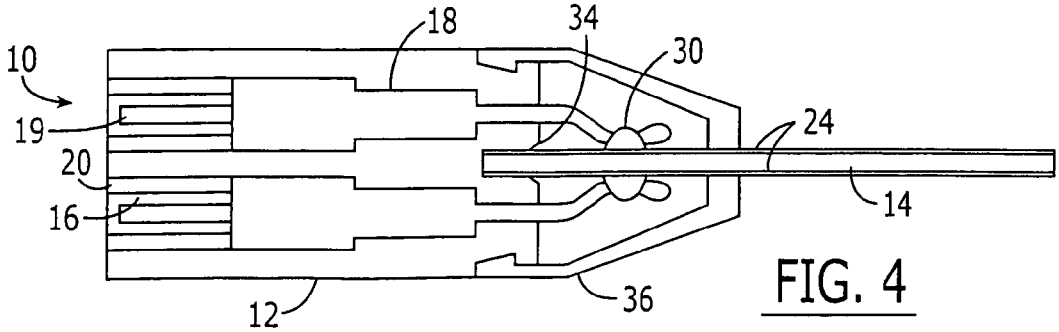
FIG. 4 illustrates a cut-away side view of an electrical insert connector and the connections between the conductive contacts of the housing and the flat wire segment(s), according to one embodiment of the present invention.

FIG. 4 illustrates a further embodiment of the electrical connector insert 10 of the present invention. In this embodiment, the housing 12 defines at least one aperture 34 to receive a portion of the flat wire segment(s) 14. The axis of aperture 34 is generally positioned substantially parallel to the axis of openings 16, but may be positioned in other orientations relative to the axis of openings 16 in other embodiments. The conductive contacts 18 or other connection elements in contact with the conductive contacts 18, as described above, extend from the housing 12 and electrically connect to the flat wire segment(s) 14 when a portion of the flat wire segment(s) is positioned within the aperture 34. Conductive traces 24 may be located on both major surfaces of the flat wire segment(s) 14, such that the conductive contacts 18 or other connection elements contact the desired conductive trace(s) 24. The conductive contacts 18 or other connection elements may be attached to the flat wire segment(s) 14 in any manner known to those skilled in the art, such as by soldering the conductive contacts 18 or other connection elements to the flat wire segment(s) at solder joints 30. In other embodiments, the conductive contacts 18 or other connection elements may be shaped and sized such that, in a resting position, the distance between the pins or other elements on either side of the flat wire segment(s) 14 is smaller than the distance between the major surfaces of the flat wire segment(s). As such, when the flat wire segment (s) 14 are positioned between the conductive contacts 18 or other connection elements, the respective contacts or other elements retain the flat wire segment(s) in the desired location by applying pressure on either side of the flat wire segment(s).

This or any other embodiment of the electrical connector insert of the present invention may also include a cover 36 to protect the portion of the flat wire segment(s) 14 that are connected to the conductive contacts 18 or other connection elements and/or provide physical support for the flat wire segment(s). For example, as shown in FIG. 4, the cover 36 may enclose at least the portion of the flat wire segment(s) 14 that is connected to the conductive contacts 18 and provide an opening for the remainder of the flat wire segment(s) to extend from the electrical connector insert. Thus, the cover 36 may be made of two halves that attach to the housing 12 in any manner known to those skilled in the art. For instance, the cover 36 and the housing 12 may be shaped to cooperate with each other such that the cover 36 may be securedly fixed onto the housing, as shown in FIG. 4. In other embodiments, the cover 36 may be molded as a part of the housing 12.

Although in the embodiments described herein the conductive traces 24 are exposed on the surface of the flat wire segment(s) where the conductive contacts 18 or other connection elements connect to or contact the conductive traces, the other portions of the conductive traces are generally protected with any abrasion-resistant, non-conductive material known to those skilled in the art, such as Tefzel®, commercially available from E.I. du Pont de Nemours and Company Corporation.

Figure 5A:
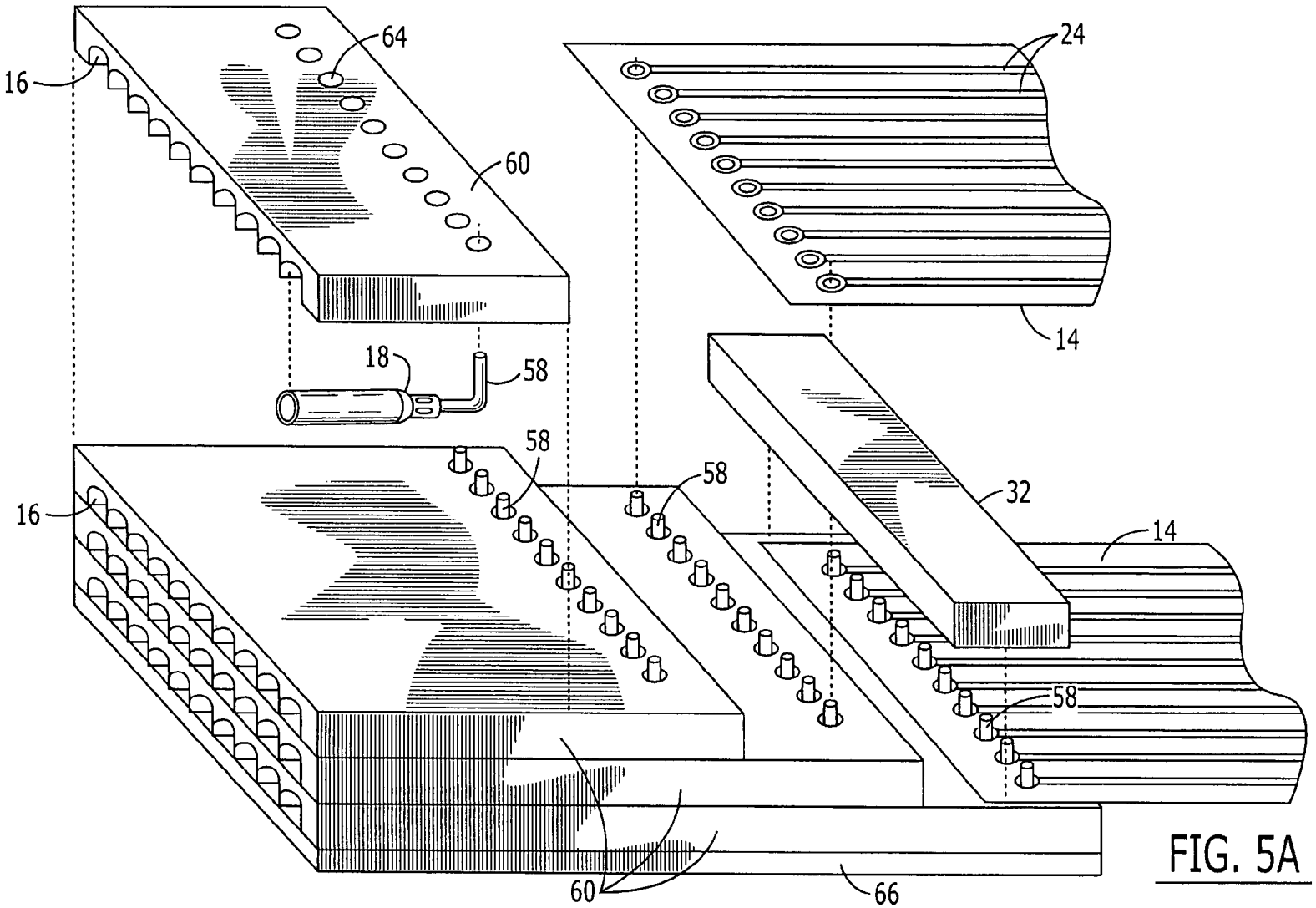
FIGS. 5A and 5B illustrates a perspective and partially exploded view of an electrical connector insert connector and the connections between the conductive contacts positioned in staggered wafers and the flat wire segment(s), according to one embodiment of the present invention.
Figure 5B:
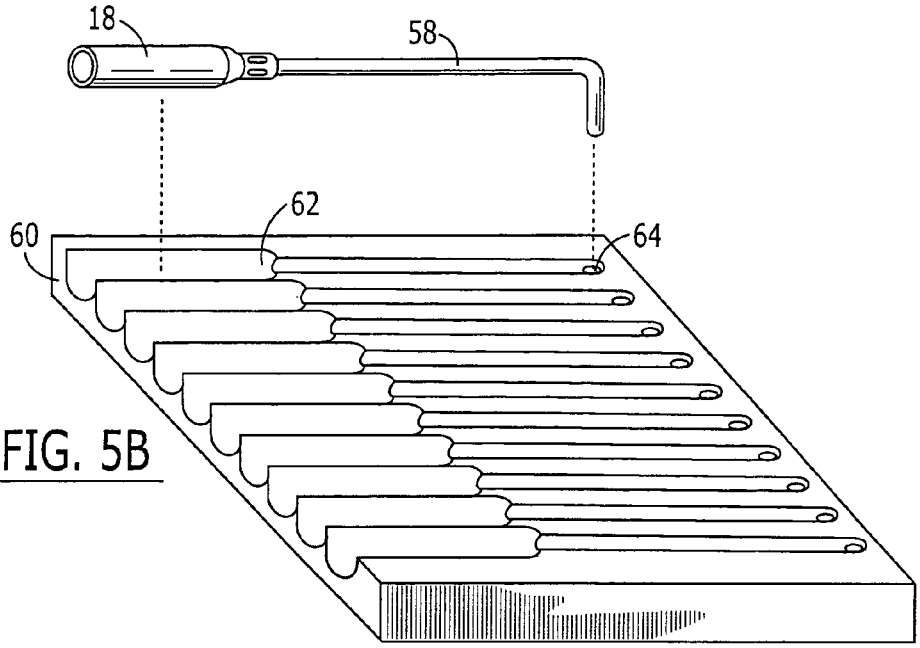

A further embodiment of an electrical connector insert is shown in FIGS. 5A and 5B. In this embodiment, the conductive contacts 18, such as conductive pins and/or conductive sockets, as described above, are attached, such as by crimping or otherwise, to conductors 58. The housing 12 of this embodiment may be made of wafers 60 that define openings 16. As shown in the embodiment of FIGS. 5A and 5B, the openings 16 may extend at least partially along one of the major surfaces of the wafer 60 as shown by portion 62 in FIG. 5B, and extend through the wafer 60 to the other major surface of the wafer 60, as shown by portion 64 in FIGS. 5A and 5B. Thus, the conductor 58 attached to a respective conductive contact 18 may be bent such that when the conductive contact 18 is positioned in an opening 16, the conductor 58 may extend from the conductive contact 18 through at least portion 64 of the opening 16, as shown in FIGS. 5A and 5B. The conductor 58 may also extend along part of portion 62 of opening 16, depending upon the distance from the end of the conductive contact attached to the conductor and portion 64 of the opening 16.

The wafers 60 may be made of any type of insulating material known to those skilled in the art. The wafers 60 may be positioned such that the major surface of each wafer that defines portion 62 of openings 16 contacts the major surface of another wafer that defines portion 64 of openings 16. In addition, the wafers 60 may be positioned such that portion 64 of openings 16 in each respective wafer 60 is exposed, as shown in FIG. 5A. Thus, the wafers 60 and the conductors 58 that attach to the conductive contacts 18 that are placed in the openings 16 are sized to permit portion 64 of openings 16 defined in an attached wafer to be exposed. As such, the portion of the conductor 58 that extends through portion 64 of opening 16 is also exposed, as shown in FIG. 5A. A cover plate 66 may be placed over the major surface that defines portion 62 of openings 16 in the wafer in which portion 62 of openings 16 are exposed after assembly of the wafers to retain the conductive contacts 18 placed in these openings. The cover plate 66 is typically made of material that is similar to the material of the wafers 60, such as an insulating material. Alternatively, the openings 16 defined in at least the outer wafer may be contained within the wafer, such that cover plate 66 is not needed. The wafers may be attached to one another in any manner known to those skilled in the art, such as by sonic welding or bonding the wafers to one another. The total number of wafers 60 utilized in the insert depends on the desired connector configuration.

Once the wafers 60 are assembled such that conductive contacts 18 are placed in the respective openings 16 and portion 64 of openings 16 and, thus, a portion of conductor 58, are exposed as shown in FIG. 5A, one or more flat wire segment(s) 14 may be attached to the conductive contacts 18. For example, as shown in FIG. 5A, each portion of the conductor 58 that is exposed from portion 64 of openings 16 may attach to a respective conductive trace 24 of the flat wire segment(s) 14, in any of the manners described with respect to attaching the conductive contacts 18 to the conductive traces 24 in the embodiments described above. Support element 32 may be located along at least a portion of a major surface of the flat wire segment 14, as shown in FIG. 5A, to provide strain relief to the flat wire segment and to protect the flat wire segment from abrasion or other abuse. The support element 32 may be made of any type of insulative material that provides sufficient support, such as a dense foam material.

Figure 6A:
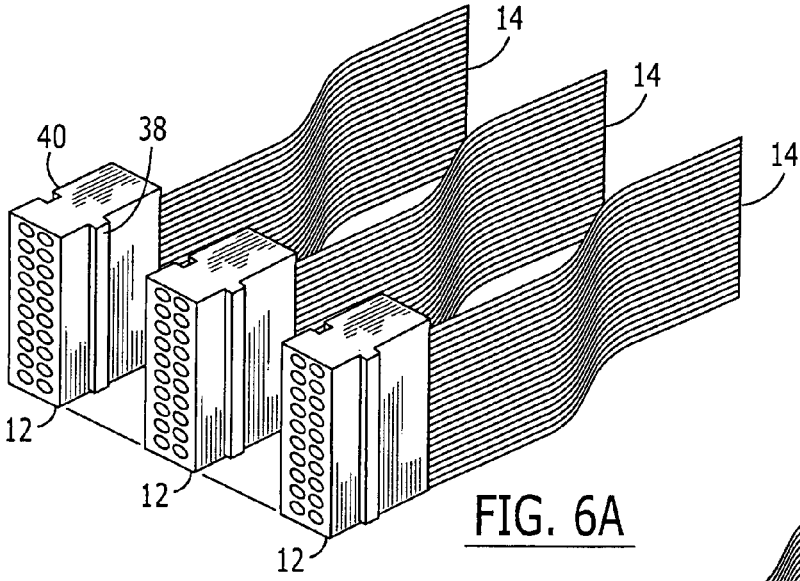
FIGS. 6A and 6B illustrate perspective views of an electrical connector insert with multiple housings adjacent to one another, according to one embodiment of the present invention.
Figure 6B:
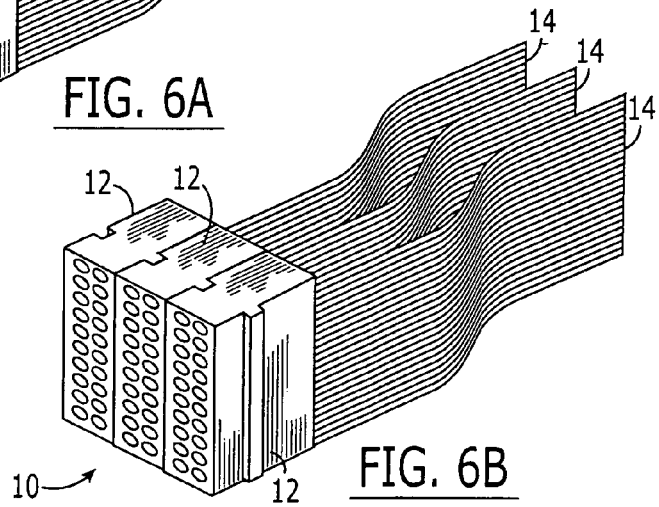

As shown in the embodiment of FIGS. 6A and 6B, more than one housing 12, each connected to or in contact with respective flat wire segment(s) 14 may be positioned adjacent one another to provide a single integrated electrical connector insert 10. For example, the housings 12 may be sized and shaped to cooperate with one another such that the housings may be securely positioned adjacent one another and may engage one another to form the electrical connector insert. As shown in the embodiment of FIGS. 6A and 6B, each housing may include a ridge 38 on one outer surface and a channel 40 on an opposite surface, such that the ridge 38 of one housing may be received within a channel of another housing to securely position and/or hold the housings together. Any other technique known to those skilled in the art for securely positioning the desired housings 12 adjacent one another may be utilized. Thus, each housing may include different arrangements of openings to receive the connector portions of at least one component, which provides added flexibility to the various types of electrical connector inserts 10 that may be created utilizing the techniques of the present invention. In addition, each housing may include different flat wire segment(s) to permit flexibility in the types of connections and routing of those connections from the electrical connector inserts 10. The electrical connector inserts 10 of the present invention are therefore capable of providing flexibility as described above without changing the industry accepted shape and/or other features of the electrical connector insert.

Figure 7:
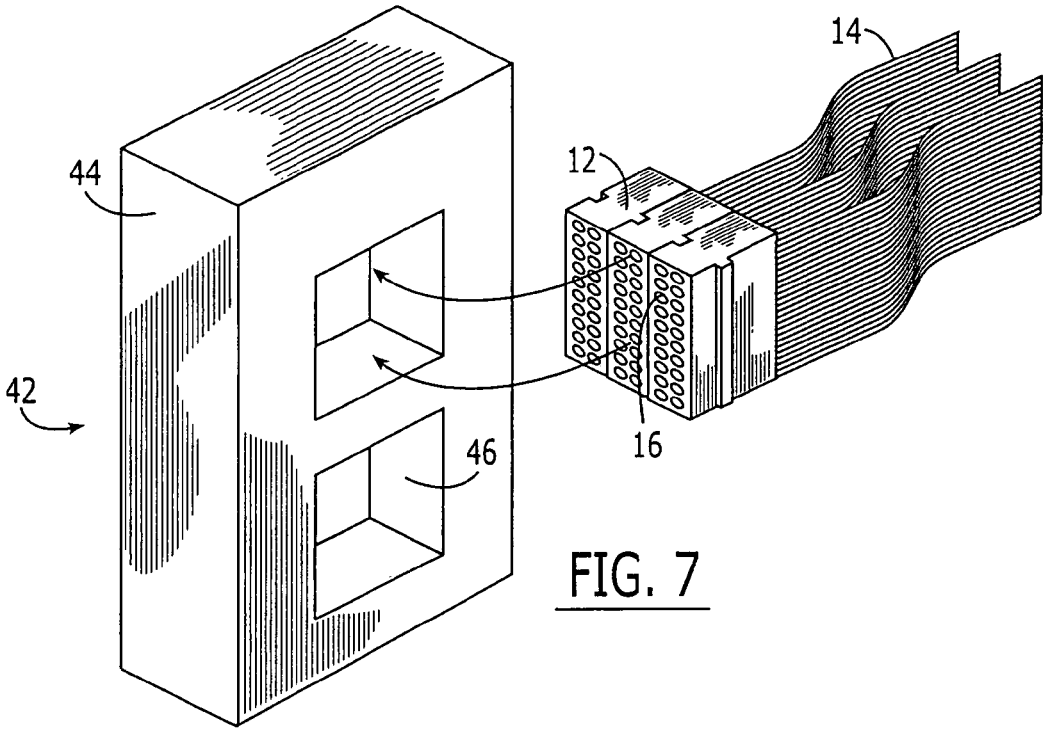
FIG. 7 illustrates a perspective view of an electrical connector apparatus, according to one embodiment of the present invention.

An electrical connector apparatus 42 is illustrated in the embodiment of FIG. 7. In this embodiment a connector insert shell 44 is capable of receiving at least one electrical connector insert 10. Thus, the connector insert shell 44 defines openings 46 sized and shaped to receive the electrical connector inserts 10 such that the openings 16 in the housing 12 of the insert 10 are located on one side of the shell 44 and the flat wire segment(s) 14 extend from the opposite side of the shell 44 when an insert is positioned within an opening 46 in the shell 44. The connector insert shell may be any type of shell known to those skilled in the art, such as a shell capable of accepting any of the family of ARINC 600 connector inserts, commercially available from Tri-Start Electronics and others. Thus, because the various connector inserts 10 described herein are capable of providing increased flexibility and attachments to flat wire segments without changing the industry accepted features of the inserts, no changes to the industry accepted connector insert shells are required either, such that the electrical connector inserts described by the present invention are easy to implement in existing systems.

Figure 8:
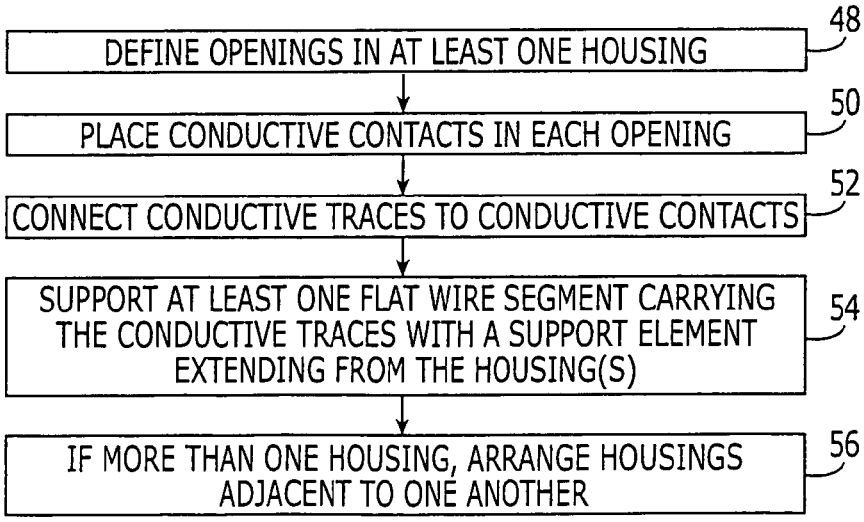
FIG. 8 is a flow diagram of a method of fabricating an electrical connector insert according to one embodiment of the present invention.

FIG. 8 illustrates one embodiment of a method for fabricating an electrical connector insert. In this embodiment, openings are defined in at least one housing to receive at least one connector portion of at least one component (step 48). The conductive contacts, such as conductive pins and/or sockets, may be placed in each opening (step 50). The conductive contacts are then connected to conductive traces carried by at least one flat wire segment (step 52). The conductive contacts may be directly connected to the conductive traces or connection elements, such as wires, may connect the conductive contacts to the conductive traces. The conductive contacts and/or connection elements may be connected to the conductive traces by soldering the conductive contacts and/or connection elements to the desired conductive traces.

This embodiment of the method of fabricating an electrical connector insert also may include supporting the flat wire segment(s) with a support element extending from the housing(s) (step 54). In embodiments of the electrical connector insert having more than one housing, the housings may be arranged adjacent one another (step 56).

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An electrical connector apparatus, comprising:

a connector insert shell, wherein said connector insert shell defines at least one opening that extends through opposite sides of said connector insert shell; and at least one electrical connector insert comprising:

at least one housing positioned within the at least one opening defined by said connector insert shell, wherein each housing comprises:

a plurality of openings to receive at least one connector portion of at least one component; and a plurality of conductive contacts, wherein each conductive contact is associated with an opening;

at least one flat wire segment disposed entirely outside of the connector insert shell and comprising a plurality of conductive traces; and a plurality of connection elements extending outwardly from the connector insert shell to connect the plurality of conductive contacts of said housing to the plurality of conductive traces of said at least one flat wire segment, said plurality of connection elements configured to establish a connection with respective conductive traces of said at least one flat wire segment at a location outside of the connector insert shell.

2. The electrical connector apparatus according to claim 1, wherein the plurality of conductive contacts of said at least one electrical connector insert comprises a plurality of at least one of conductive pins and conductive sockets.

3. The electrical connector apparatus according to claim 1, wherein the plurality of connection elements of said at least one electrical connector insert comprise wire segments extending from the plurality of conductive contacts to the plurality of conductive traces of the at least one flat wire segment.

4. The electrical connector apparatus according to claim 1, wherein the plurality of conductive traces of said at least one electrical connector insert comprise at least one connection via, and wherein the plurality of connection elements connect the plurality of conductive contacts of the housing to respective conductive traces of said at least one flat wire segment through the at least one connection via of the conductive traces.

5. The electrical connector apparatus according to claim 1, wherein the plurality of connection elements of said at least one electrical connector insert comprise a plurality of solder joints to connect the plurality of connection elements to the at least one flat wire segment.

6. The electrical connector apparatus according to claim 1, wherein the housing of said at least one electrical connector insert further comprises a support element to support at least a portion of the at least one flat wire segment of said at least one electrical connector insert.

7. An electrical connector apparatus comprising:

a connector insert shell, wherein said connector insert shell defines at least one opening that extends through opposite sides of said connector insert shell; and at least one electrical connector insert positioned within the at least one opening defined by said connector insert shell, wherein said at least one electrical connector insert comprises:

at least one housing, wherein each housing comprises:

a plurality of openings to receive at least one connector portion of at least one component; and a plurality of conductive contacts, wherein each conductive contact is associated with an opening;

at least one flat wire segment comprising a plurality of conductive traces; and a plurality of connection elements to connect the plurality of conductive contacts of said housing to the plurality of conductive traces of said at least one flat wire segment, wherein the at least one housing of said at least one electrical connector insert defines an aperture to receive a portion of the at least one flat wire segment, wherein the at least one flat wire segment of said at least one electrical connector insert comprises first and second opposed major surfaces with conductive traces defined on the first and second major surfaces, and wherein the connection elements of said at least one electrical connector insert connect the plurality of conductive contacts to the plurality of conductive traces on both the first and second major surfaces when the portion of the at least one flat wire segment is positioned within the aperture in the housing.

8. The electrical connector apparatus according to claim 1, wherein the at least one housing of said at least one electrical connector insert comprises a plurality of housings and wherein the plurality of housings are sized and shaped to cooperate with each other to fit within the same opening defined by said connector insert shell.

9. The electrical connector apparatus according to claim 1, wherein the at least one housing of said at least one electrical connector insert further comprises at least one wafer defining the plurality of openings.

10. The electrical connector apparatus according to claim 1, wherein the plurality of openings defined by the at least one housing of the at least one electrical connector insert are configured to receive respective connector portions of one or more rack mounted components.

11. The electrical connector apparatus according to claim 1, wherein the plurality of openings defined by the at least one housing of the at least one electrical connector insert are configured to receive respective connector portions of a line replaceable unit.

* * * * *